US007553097B2

(12) United States Patent
Salussolia et al.

(10) Patent No.: US 7,553,097 B2
(45) Date of Patent: Jun. 30, 2009

(54) DEVICE FOR DETECTING END OF PAPER IN A PRINTER

(75) Inventors: Piero Salussolia, Ivrea (IT); Alberto Colombi, Ivrea (IT)

(73) Assignee: Telecom Italia S.p.A., Milan (IT)

( * ) Notice: Subject to any disclaimer, the term of this patent is extended or adjusted under 35 U.S.C. 154(b) by 438 days.

(21) Appl. No.: 10/561,797

(22) PCT Filed: Jun. 22, 2004

(86) PCT No.: PCT/IT2004/000360

§ 371 (c)(1),
(2), (4) Date: Dec. 21, 2005

(87) PCT Pub. No.: WO2004/113088

PCT Pub. Date: Dec. 29, 2004

(65) Prior Publication Data

US 2006/0285908 A1 Dec. 21, 2006

(30) Foreign Application Priority Data

Jun. 25, 2003 (IT) ..... TO2003A0475

(51) Int. Cl.
*B41J 29/38* (2006.01)
*B41J 15/04* (2006.01)
*B65H 16/02* (2006.01)

(52) U.S. Cl. ..... 400/613; 242/563; 242/563.2

(58) Field of Classification Search ..... None
See application file for complete search history.

(56) References Cited

U.S. PATENT DOCUMENTS 5,820,068 A * 10/1998 Hosomi et al. ..... 242/563

FOREIGN PATENT DOCUMENTS

| | | | |
|---|---|---|---|
| EP | 1 231 070 A | | 8/2002 |
| JP | 58116184 A | * | 7/1983 |
| JP | 9 254474 A | | 9/1997 |
| JP | 2001 206602 | | 7/2001 |
| JP | 2001206602 A | * | 7/2001 |

OTHER PUBLICATIONS

Machine translation of JP 2001206602 to Tozaki from Japanese Patent Office website, Jul. 2001.*
Patent Abstracts of Japan, vol. 2000, No. 24, May 11, 2001.
Patent Abstract of Japan, vol. 1998, No. 01, Jan. 30, 1998.

* cited by examiner

*Primary Examiner*—Daniel J Colilla
(74) *Attorney, Agent, or Firm*—Venable LLP; Robert Kinberg; Steven J. Schwarz

(57) ABSTRACT

The device (18) for detecting end of paper comprises a support (43) mounted on a wall (26) of a printer (10) of receipts, obtained from a tape (12) of paper wound on a roll (14), contained in a housing (15) of the printer (10). The printer (10) is preferentially employed at a Point Of Sale (POS) and may be arranged on a horizontal work plane (21) set on its base (22), or inclined by about 90°, on a front wall (24). As a result, the roll (14) is set into the housing (15) alternatively in two positions, corresponding to the inclination assumed by the printer. A detecting lever (54) in hinge-mounted on the support (43) and is provided with two arms (55, 56) spread apart, forming an angle of approximately 120°. Fixed to each of the ends of the arms (55, 56) is a projecting element (58, 60), each of which suitable for engaging a hole in a central sprocket (17) of the roll (14), when the latter has reached its minimum dimension, in which a given length of tape remains of the sprocket (17), indicating that the latter is closed to running out. The two projecting elements (58, 60) are positioned in such a way that only one of these enters the hole in the sprocket (17), when the printer (10) is set in one of the two positions; the support (43) is moved linearly on the wall (26) by way of a toothed cam (47), in order to adapt the position of each of the projecting elements to the dimensions of the sprocket (17) of the paper roll.

8 Claims, 4 Drawing Sheets

DEVICE FOR DETECTING END OF PAPER IN A PRINTER

This application is a U.S. National Stage application of co-pending PCT application PCT/IT2004/000360, filed Jun. 22, 2004, which claims the priority of Italy Patent Application No. TO02003A000475, filed Jun. 25, 2003. These applications are incorporated herein by reference in their entireties.

1. Field of the Invention

This invention relates to an end of paper detecting device for a printer, and more particularly to a device for detecting a predetermined remaining length of paper tape, that is left deliberately on the roll to inform the operator of the imminent end of the tape.

2. Brief Description of the State of the Art

Generally the device is used to advantage on a printer of a type known in the art, for instance a specialized printer for retail Points Of Sale (POS).

A printer of this type is preferably a conventional type, parallel, thermal printer, in which information is printed on a tape of treated paper, which unwinds from a roll placed in an appropriate housing inside the casing of the printer; normally the paper roll is arranged with its outer surface resting through gravity on inclined planes, which maintain the roll in a stable position, to guarantee proper unwinding of the tape during printing.

A specialized point-of-sale printer, as indicated above, is normally set on a horizontal plane, but in certain situations can also be inclined, for instance, set against a vertical plane and rotated though about 90°, to reduce the amount of space occupied on the work plane.

In the latter case, the housing for the paper roll is provided with further inclined planes, suitable for supporting and holding the roll in the correct position while the tape is unwinding, in a way compatible with the printer's changed disposition.

Accordingly, the device for detecting end of paper must also be able to adapt easily to both positions of the paper roll, in order to correctly detect the approaching end of the tape, both when the printer is set on a horizontal plane, and when the printer is inclined.

In the U.S. Pat. Nos. 5,820,068 and 5,884,861 a printer of the type mentioned above is described, feedable with a paper roll and provided with equipment for detecting and reporting the imminent end of paper.

The equipment for detecting end of paper is located externally to the casing of the printer and comprises a support mounted rotatingly with respect to the casing.

Mounted on the support is a lever having a first protrusion suitable for engaging the hole in sprocket of the paper roll, when the roll has decreased in size, and a second protrusion suitable for lying against the edge of the roll to maintain the first protrusion separate from the sprocket, in order to guarantee that the first protrusion penetrates into the hole in the sprocket only when the paper roll has decreased to a predetermined size, corresponding to the imminent end of the paper tape.

At this point the second protrusion is no longer lying against the side of the roll and thus allows the first protrusion to penetrate into the hole in the sprocket, which causes the lever to turn, and this in turn actuates a microswitch to report the end of paper condition.

The detecting equipment support may be rotated manually between different angular positions, corresponding to the positions assumed by the paper roll when the printer is set on a horizontal plane, or when it is inclined, or again when it is rotated against a vertical support.

This end of paper detecting equipment has the drawback of requiring the intervention of an operator to adjust the orientation of the support each time that the printer's support orientation is changed and in function of the initial dimensions of the paper roll, inserted in the printer.

SUMMARY OF THE INVENTION

The main object of the present invention therefore is to produce a device for detecting end of paper for a printer, which does not have the drawback encountered in the known types of similar equipment.

Another object of this invention is to produce a device for detecting end of paper which automatically adapts itself to the orientation assumed by the printer, without requiring any operator intervention.

A further object of the invention is to produce-a device for detecting end of paper that is simple to construct and highly reliable.

DETAILED DESCRIPTION OF A PREFERRED EMBODIMENT

Figure 1:
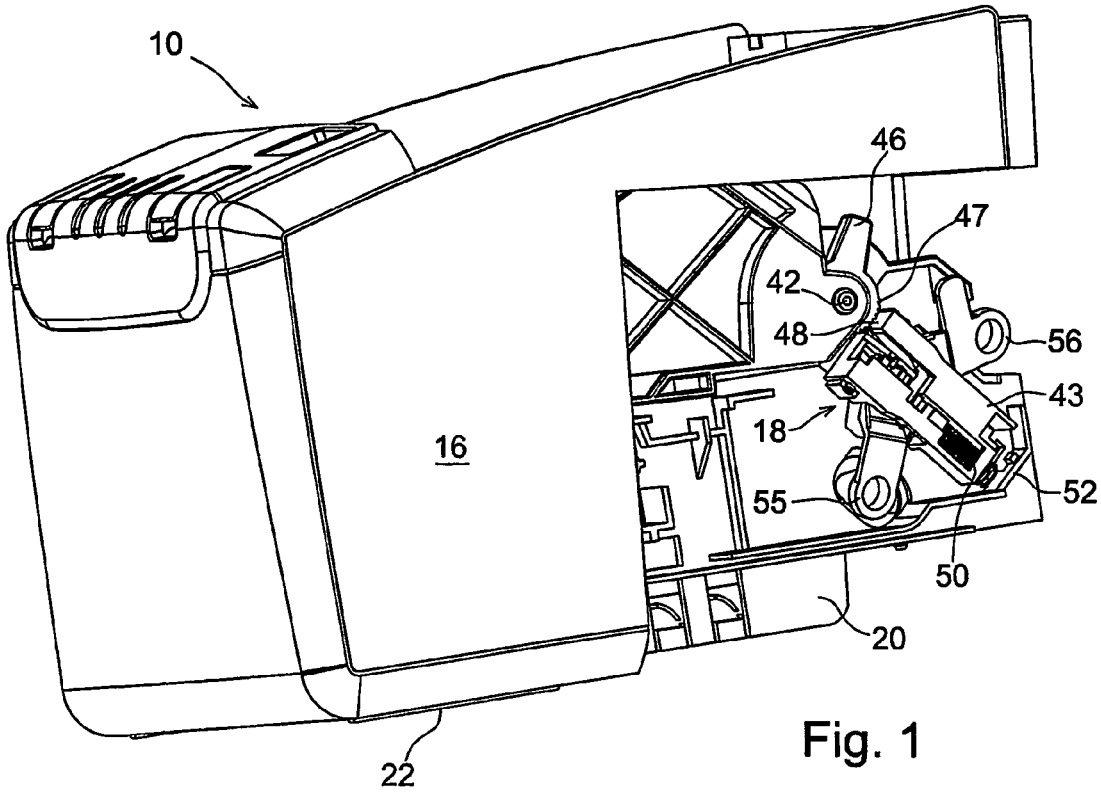
FIG. 1 is a lateral, perspective view, in partial section, of a printer using the device for detecting end of paper, as described by the present invention.
Figure 2:
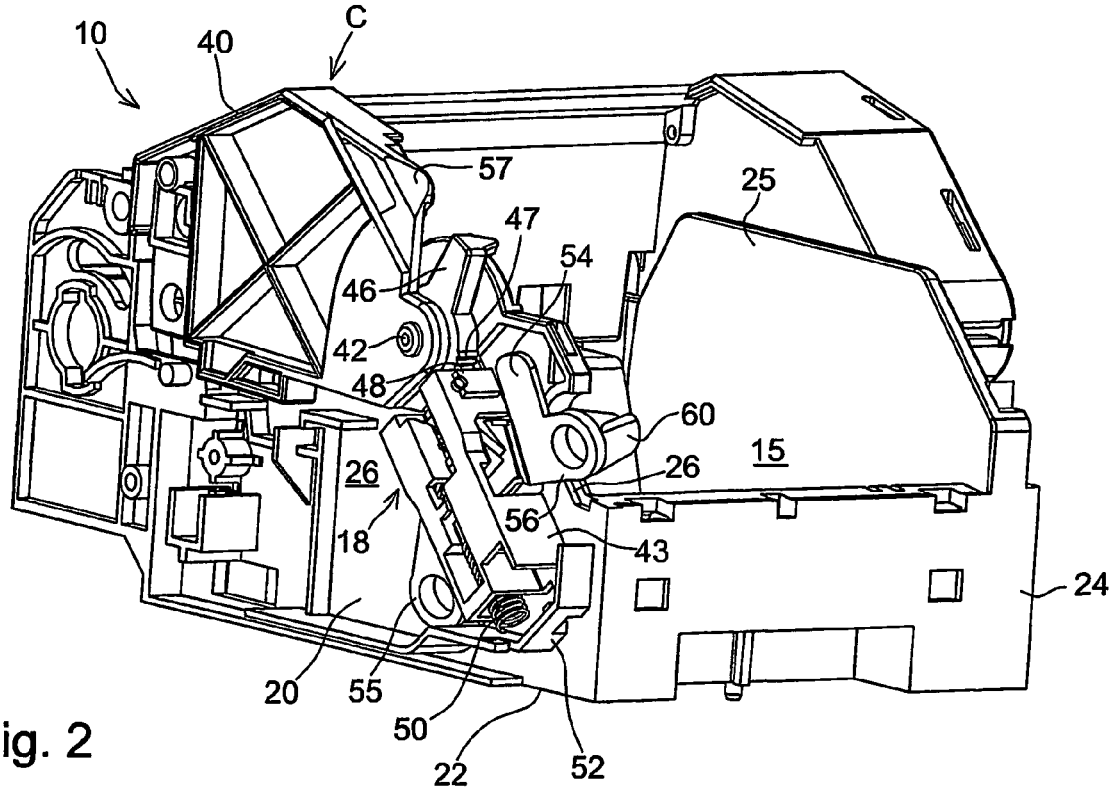
FIG. 2 is a lateral, perspective view of the printer of FIG. 1, without a casing.

With reference to FIGS. 1-8, in which the numeral 10 is used to indicate a printer of the type used in points of sale (POS), preferably thermal type, which prints information on a tape 12 of treated paper, which unwinds from a roll 14 (FIGS. 7 and 8), in turn accommodated in a housing 15 on the inside of a casing 16 of the printer 10. The roll 14 is generally made of a sprocket 17 on which the paper tape 12 is wound.

For clarity's sake, in FIG. 1 part of the casing 16 has been removed in order to reveal a device 18 for detecting end of paper, according to this invention.

The printer 10 comprises a main, fixed frame 20, bounded by a bottom wall 22 (FIG. 2) and a front wall 24. On the inside of the frame 20 is the housing 15 for the paper roll 14. The housing 15 is bounded by two lateral and opposite walls 25 and 26 (FIG. 3), and by a bottom wall 28, suitable for supporting the roll 14.

Figure 7:
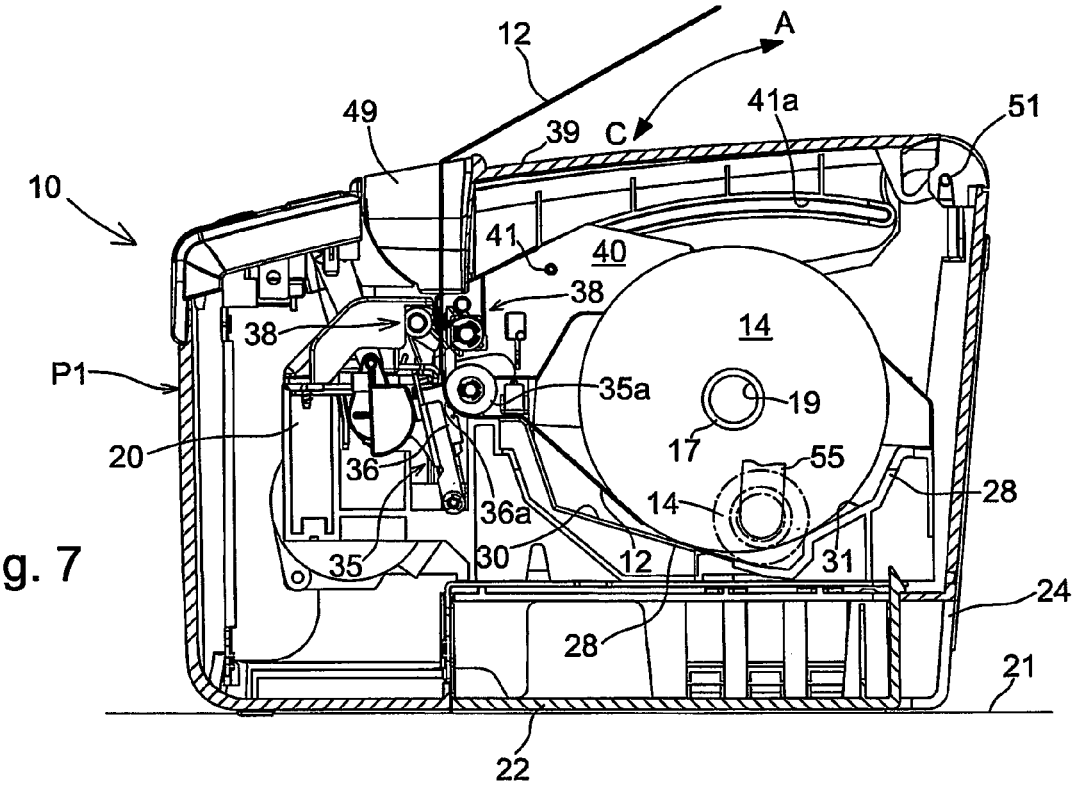
FIG. 7 is a longitudinal section of the printer of FIG. 1, when set on its base.
Figure 8:
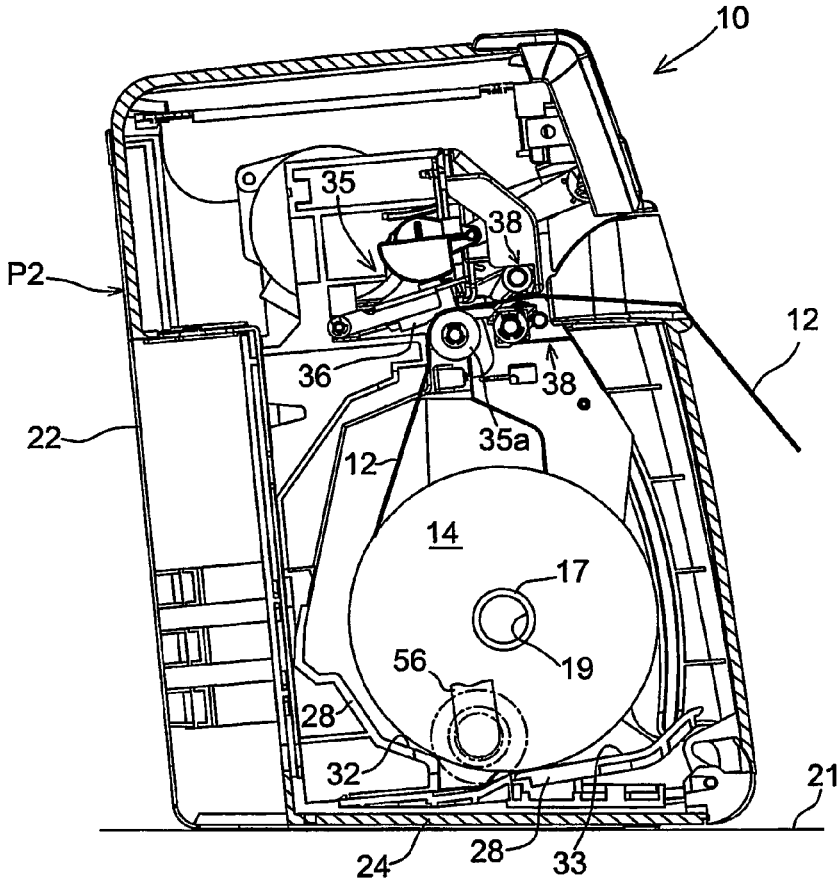
FIG. 8 is a longitudinal section of the printer of FIG. 1, when it is set on a frontal wall.

The printer 10 is prearranged to work indifferently in operating positions having different orientations, and is in particular suitable for working in one or the other of two operating positions, respectively indicated P1 and P2 (FIGS. 7, 8).

In greater detail, the printer 10 may be set on a work plane 21 horizontal with the base 22 (FIG. 7) or, in certain situations, to reduce the space occupied on the work plane 21, it may also be set inclining, for example, against a vertical plane, or rotated by about 90°, set on its front wall 24 (FIG. 8).

So that the paper roll 14 may always be correctly disposed, when the printer 10 is positioned in one or the other of the two above-mentioned positions P1 and P2, the bottom wall 28 is divided into various support surfaces, having different inclinations, to offer the paper roll a stable support in each case.

Therefore the bottom wall 28 is divided into two pairs of support surfaces 30, 31 and 32, 33 (FIGS. 7, 8), flat and variously inclined. When the printer 10 is set with the bottom wall 22 on the work plane 21, the roll 14 lies against the surfaces 30 and 31 (FIG. 7), whereas when the printer 10 is set with the front wall 24 on the same work plane 21, the roll 14 lies against the surfaces 32 and 33 (FIG. 8).

The printer 10 also comprises a printing group 35 (FIGS. 4, 7) of the thermal, parallel printing type, known in the sector art, suitable for printing information on the tape 12 coming from the roll 14, and a cutting unit 38, consisting of an automatic cutter with movable blades, of a type also known in the art, suitable for cutting a stub of tape, or receipt, after the printing and feeding of the tape 12.

In detail, the printing group 35 comprises a printhead 36, in the form of a board and typically made of silicon, which is fixed upon a support mounted on the fixed main frame 20 and which bears a row of heating elements 36*a*.

In use, the printhead 36 is urged resiliently against a contrast roller or platen 35*a*, mounted rotatingly on a movable structure 40 hinge-mounted on the frame 20 and better described later on, with the tape 12 in between and thus pressed between the thermal printhead 36 and the platen 35*a*. In addition, under these conditions, the platen 35*a* rotates to produce feeding of the tape 12 and its unwinding from the roll 14, whereas at the same time the heating elements 36*a* of the printhead 36 are selectively excited for the printing, through thermal effect, of information on the tape 12 of thermal or treated paper.

In turn, the cutting unit 38 is openable type and comprises a first blade provided on the frame and a second blade provided on the movable structure 40 (FIG. 4), in such a way that the two blades can be detached, and the cutting unit 38 opened, when the structure 40 is moved away from the fixed frame 20 to permit access to the internal housing 15.

In particular, the structure 40 can be rotated about pins 42, from a closed position "C" (FIG. 2), in which the structure 40 is overturned on the frame 20 at the end opposite the front wall 24, to an open position "A" (FIG. 4), in which the structure 40 is overturned in the direction of the front wall 24.

In particular, rotation of the structure 40 with respect to the frame 20 is commanded by means of the rotation of a cover 39, in turn fulcrum-mounted on the frame 20 by means of a pin 51 (FIG. 7).

The structure 40 is connected to the cover 39 by means of a link-block made of a pin 41, projecting laterally from the structure 40 and engaging with a groove 41*a* in the cover 39.

In addition, the cover 39 is kept in the closed position "C" by means of a latch, not depicted, which, when it is opened by means of a button 49, causes the thermal head 36 to move away from the platen 35*a*; in this way, the cover 39 and the structure 40 may be rotated with respect to the frame 20 without sliding occurring under the load of the heating elements 36*a* against the contrast roller 35*a*.

When the structure 40 is rotated into the position "A", the housing 15 stays open, and the operator can have access to it in order to replace the finished roll with a new roll 14, or for ordinary maintenance.

In particular, in position "A", a new roll 14 can be easily and comfortably inserted in the housing 15, arranging the relative strip of paper 12 so that it passes over the printhead 36, so that, when the structure 40 is again rotated into position "C", the strip of paper 12 is already correctly positioned for printing, between the printhead 36 and the platen 35*a*, and also for cutting by the cutting unit 38.

Figure 3:
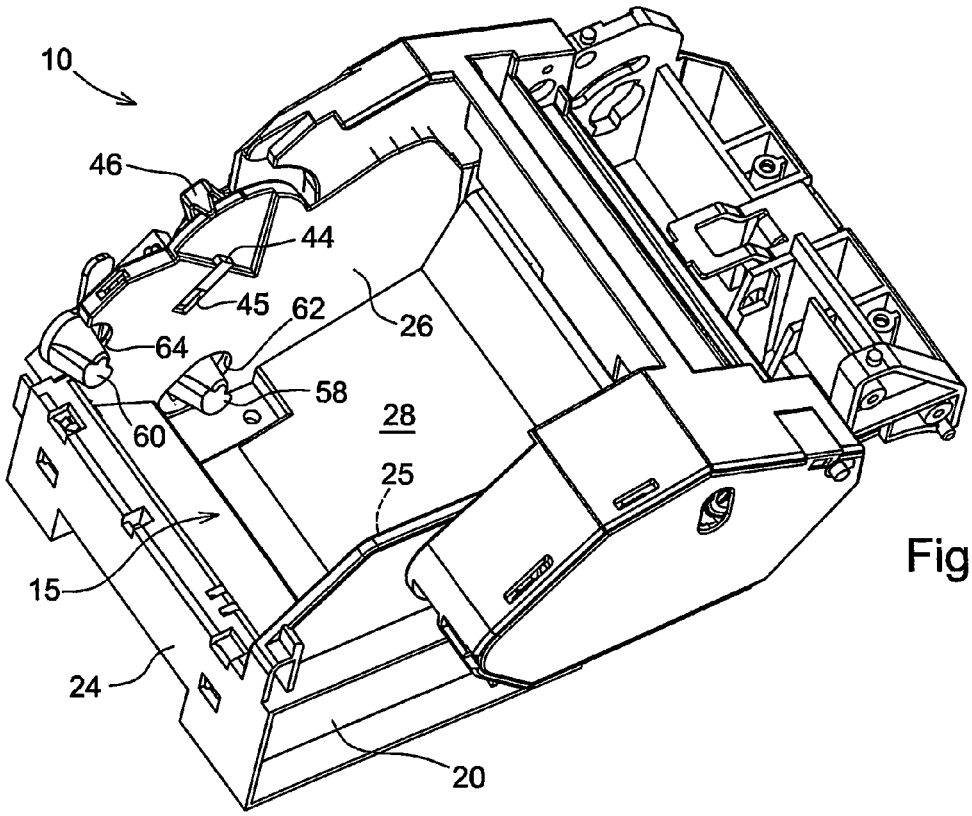
FIG. 3 is a perspective view from the top of the printer of FIG. 2.
Figure 5:
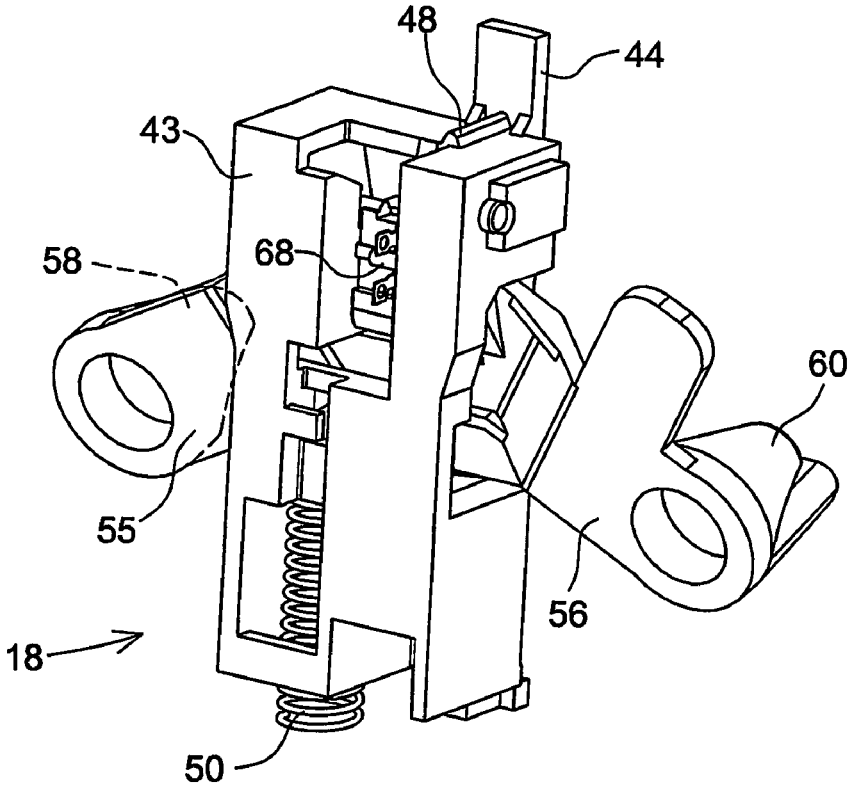
FIG. 5 is a lateral, perspective view of the device for detecting end of paper, used on the printer of FIG. 1.
Figure 6:
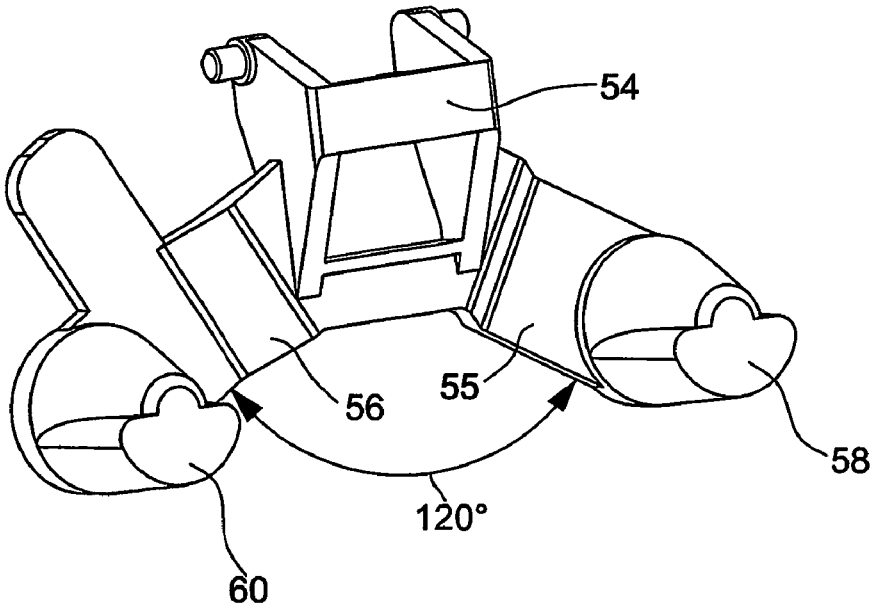
FIG. 6 shows a detail of the device of FIG. 5.

The device 18 for detecting end of paper is shown in FIG. 5, and comprises a support 43, which can slide linearly on the wall 26 of the housing 15, steered by a guide 44, engaging in a groove 45 of the wall 26 (FIG. 3). The position of the support 43 is controlled by a regulating member (FIG. 2), consisting of a rotating arm 46, screwed on to pins 42 and integral with a toothed cam 47; the toothed cam 47 engages a tooth (FIGS. 1, 5) of the support 43, so that for a rotation of the arm 46, there is a corresponding linear movement of the support 43. A spring 50, placed between the support 43 and a projection 52 of the frame 20 resiliently contrasts the movements of the support 43, guaranteeing a regular movement in the two directions.

Hinge-mounted on the support 43 is a detecting lever 54 (FIGS. 5, 6), provided with two arms 55 and 56, which diverge one from the other, and together form an angle of about 120°. Each of the arms 55 and 56 bears on its end a projecting element 58 and 60 respectively, said projecting elements 58 and 60 extending substantially in a direction perpendicular to the plane of the lever 54, towards the inside of the housing 15, passing through two apertures 62 and 64 in the wall 26 (FIG. 3).

The two projecting elements 58 and 60 are constantly urged towards the inside of the housing 15 by means of an elastic member, not shown in the drawings, which is mounted on the support 43 and which acts on the lever 54, so that each of the projecting elements rests against an edge of the paper roll 14, when it is inserted in the housing 15, in each of the two positions of the printer 10.

To facilitate the insertion of a new paper roll, when the structure 40 is rotated to the open position "A", the elements 58 and 60 are kept back from the wall 26 by means of a wedge element 57 integral with the structure 40 (FIGS. 2, 4) and provided for cooperating with the lever 54.

Accordingly when the structure 40 is rotated to the closed position "C", one or the other of the projecting elements 58 and 60 rests against an edge of the paper roll 14, until when the length of the paper tape remaining on the roll 14 reaches a predefined, minimum value, in correspondence with which, the projecting element concerned, 58 or 60, enters a hole 19 in the sprocket 17 of the roll 14, and causes rotation of the lever 54, which in turn activates a microswitch 68, mounted on the support 43, thus generating an end of paper signal.

For clarity's sake, the position of the paper roll 14 when it reaches its minimum dimension and therefore either one or the other of the projecting elements 58 and 60 penetrates into the sprocket 17, is indicated with the dot and dash line in FIGS. 7 and 8.

According to one of the objects of this invention, the arms 55 and 56 of the lever 54 are sized in such a way that only one of the two projecting elements 58, or 60, can engage the hole 19 in the sprocket 17, when the paper tape is close to running out, in whatever way the printer 10 is oriented on the work plane 21.

Figure 4:
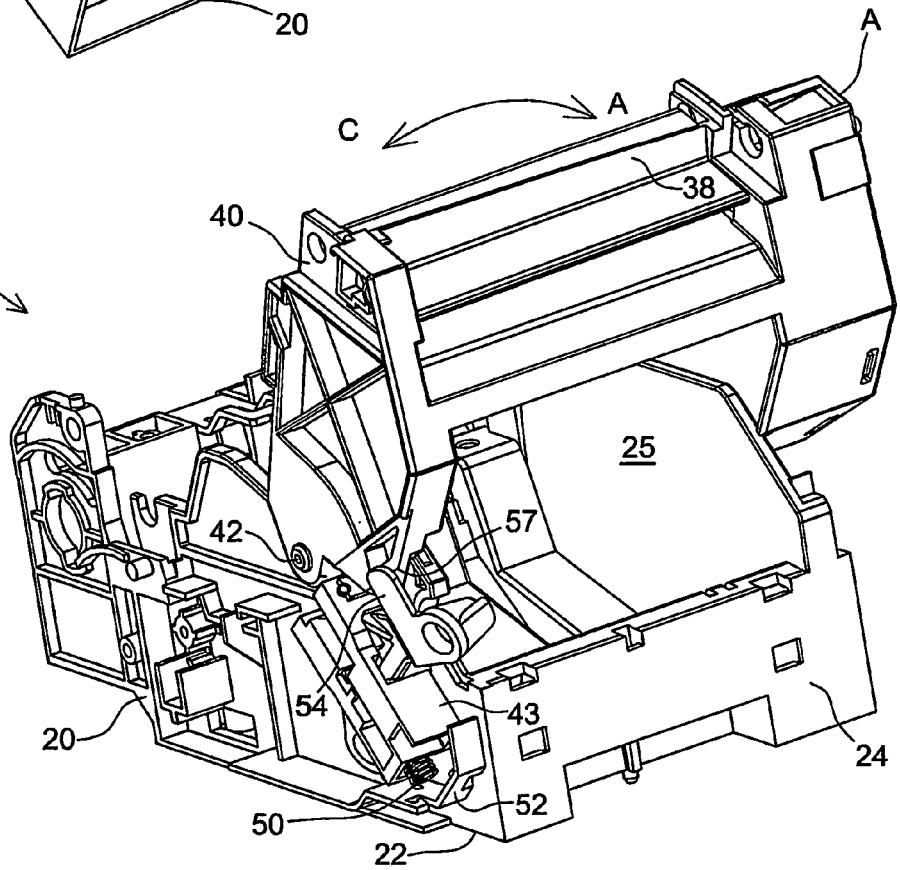
FIG. 4 is a lateral, perspective view of the printer of FIG. 2 with a respective cutting unit in overturned position.

In particular, when the printer 10 is set on the work plane 21 horizontal with the base 22 (FIGS. 2, 7), the new roll 14 of paper is inserted freely in the housing 15, as the lever 54 is kept away from the structure 40 rotated into position "A" (FIG. 4). The new roll 14 is therefore disposed by gravity against the surfaces 30 and 31 of the bottom wall 28 (FIG. 7).

In this situation, the projecting element provided for reporting the end of paper condition, for instance the projecting element 58, remains against the edge of the paper roll 14, while the latter decreases in diameter on account of the tape being withdrawn.

Then, when the dimension of the paper roll 14 reaches its minimum level, corresponding to the scheduled remaining length of the paper tape, still wound on the sprocket 17, the projecting element 58 can penetrate into the hole 19 in the sprocket 17 of the roll, while the projecting element 60 remains free to move in the inside of the housing 15, since the roll is no longer capable of impeding its movement, on account of having reached the minimum dimension.

A similar situation arises when the printer 10 is set on the work plane 21 with its front wall 24 (FIG. 8).

In this position a new roll 14 of paper lies against the surfaces 32 and 33 of the bottom wall 28 and, when the paper roll 14 has reached its minimum dimension, corresponding to the scheduled remaining length, the projecting element 60 can penetrate into the hole 19 of the corresponding sprocket 17, while the projecting element 58, now on the outside of the clearance area of the roll 14, does not interfere with its edge.

It remains understood, therefore, that changes in the shape and size of the various components, and also improvements, or additions and/or substitutions of parts may be made to the device for detecting end of paper for a printer, according to this invention, without departing from the scope of the invention.

The invention claimed is:

1. Device for detecting end of paper for a printer, wherein said paper is wound on a roll placed in a housing, said roll being adapted to assume different positions in said housing, respectively when said printer is in a first, or in a second operating position, said detecting device comprising sensor means adapted to cooperate with a core of said roll, when said roll contains a predetermined minimum length of paper, wherein said sensor means comprises a lever movable with respect to said housing, comprising two arms bearing at one end a respective projecting element each projecting element being adapted to engage a hole in said core, respectively when said printer is in said first, or in said second operating position, wherein said device further comprises a support mounted to linearly slide on a lateral wall of the housing, and moved by a cam-type regulating member, rotating on said wall, to adapt the position of each of said projecting elements to different dimensions of said core.

2. Device according to claim 1, wherein said lever is fulcrum-mounted on said support, said lever assuming one or the other of two angular positions according to a plane perpendicular to said wall, respectively when said projecting elements are lying against the edge of said roll, or when only one of said projecting elements engages the hole in said core.

3. Device according to claim 1, in that said lever cooperates with a microswitch to generate an end of paper signal when one or the other of said projecting elements engages the hole in said core.

4. Device according to claim 1 wherein said two arms of said lever are reciprocally spread apart and together form an angle of about 120°.

5. Device according to claim 1 wherein said two arms are sized in such a way that only one of said projecting elements can engage said hole, respectively in each of said operating positions of said printer.

6. Device according to claim 1 wherein said housing is provided with at least two groups of support surfaces, the support surfaces of each of said groups being adapted to support said roll, respectively when said printer is in said first, or in said second operating position.

7. Printer for receipts made from a paper tape wound on a roll placed in a housing of said printer, said roll being adapted to assume different positions in said housing, respectively when said printer is in a first, or in a second operating position, said printer comprising a printing group for printing information on said receipts, a cutting unit for separating said receipts from said paper tape, and a device for detecting end of paper comprising sensor means adapted to cooperate with a core of said roll, when said roll contains a predetermined length of paper, said sensor means comprises a lever that is movable with respect to said housing, provided with two arms bearing at one end a projecting element, each projecting element being adapted to engage a hole in said core, respectively when said printer is in said first, or in said second operating position, wherein said printer further comprises a support mounted to linearly slide on a lateral wall of the housing, and moved by a cam-type regulating member, rotating on said wall, to adapt the position of each of said projecting elements to different dimensions of said core.

8. Device for detecting end of paper for a printer, wherein said paper is wound on a roll placed in a housing, said roll being adapted to assume different positions in said housing, respectively when said printer is in a first, or in a second operating position, said detecting device comprising a sensor adapted to cooperate with a core of said roll, when said roll contains a predetermined minimum length of paper, wherein said sensor comprises a lever movable with respect to said housing, comprising two arms bearing at one end a respective projecting element each projecting element being adapted to engage a hole in said core, respectively when said printer is in said first, or in said second operating position, wherein said device further comprises a support mounted to linearly slide on a lateral wall of the housing, and moved by a cam-type regulating member, rotating on said wall, to adapt the position of each of said projecting elements to different dimensions of said core.

* * * * *